US009328574B2

(12) United States Patent
Sehsah

(10) Patent No.: US 9,328,574 B2
(45) Date of Patent: May 3, 2016

(54) METHOD FOR CHARACTERIZING SUBSURFACE FORMATIONS USING FLUID PRESSURE RESPONSE DURING DRILLING OPERATIONS

(75) Inventor: Ossama R. Sehsah, Katy, TX (US)

(73) Assignee: Smith International, Inc., Houston, TX (US)

( * ) Notice: Subject to any disclaimer, the term of this patent is extended or adjusted under 35 U.S.C. 154(b) by 1077 days.

(21) Appl. No.: 13/415,952

(22) Filed: Mar. 9, 2012

(65) Prior Publication Data

US 2012/0228027 A1 Sep. 13, 2012

Related U.S. Application Data

(60) Provisional application No. 61/450,651, filed on Mar. 9, 2011.

(51) Int. Cl.

| | |
|---|---|
| ***E21B 21/08*** | (2006.01) |
| ***E21B 47/10*** | (2012.01) |
| ***E21B 49/00*** | (2006.01) |

(52) U.S. Cl.

CPC ..... *E21B 21/08* (2013.01); *E21B 49/008* (2013.01)

(58) Field of Classification Search

CPC E21B 21/08; E21B 49/008; E21B 2041/0028
USPC ..... 175/48; 73/152.21, 152.22
See application file for complete search history.

(56) References Cited

U.S. PATENT DOCUMENTS

| | | | | |
|---|---|---|---|---|
| 5,303,582 | A * | 4/1994 | Miska | 73/152.21 |
| 6,058,771 | A | 5/2000 | Johnson et al. | |
| 6,904,981 | B2 | 6/2005 | van Riet | |
| 7,395,878 | B2 | 7/2008 | Reitsma et al. | |
| 2008/0099241 | A1 * | 5/2008 | Ibrahim et al. | 175/40 |
| 2009/0107669 | A1 * | 4/2009 | Elphick | E21B 43/20 166/254.1 |
| 2011/0024195 | A1 * | 2/2011 | Hoyer et al. | 175/65 |

(Continued)

FOREIGN PATENT DOCUMENTS

| | | | | |
|---|---|---|---|---|
| RU | 2371576 C1 * | 10/2009 | | E21B 47/10 |
| RU | 2380528 C1 | 1/2010 | | |
| WO | WO 9848145 A1 * | 10/1998 | | E21B 23/03 |

OTHER PUBLICATIONS

Author: Majid Davoudi, Title: "A Simulation-Based Evaluation of Alternative Initial Responses to Gas Kicks During Managed Pressure Drilling Operations", Date: Nov. 13, 2009, Publisher: Louisiana State University, URN: etd-11132009-105045, pages containing Bibsheet and Thesis: 1-221.*

(Continued)

*Primary Examiner* — Lisa Caputo
*Assistant Examiner* — Roger Hernandez-Prewitt
(74) *Attorney, Agent, or Firm* — David J Smith

(57) ABSTRACT

A method for characterizing a subsurface formation using a fluid pressure response during wellbore drilling operations includes the steps of determining a change in wellbore pressure proximate the surface, calculating a change in volumetric flow rate out of the wellbore as a function of the change in wellbore pressure proximate the surface, determining a downhole fluid pressure in the wellbore corresponding to the change in wellbore pressure proximate the surface and determining a productivity index value as a function of the change in volumetric flow rate, the downhole fluid pressure and a reservoir pressure.

15 Claims, 4 Drawing Sheets

(56) References Cited

U.S. PATENT DOCUMENTS

2011/0087473 A1* 4/2011 Jimenez Chavez ..... E21B 49/00 703/2
2012/0067591 A1* 3/2012 Couturier et al. ..... 166/373

OTHER PUBLICATIONS

Author: unknown, Title: "Productivity Index", Date: May 15, 2008, Publisher: Petroleum Engineering, pp. 1, accessed from URL: http://petmuh.blogspot.com/search/label/productivity%20index.*

Authors: Asis K. Das, John Rogers Smith and Philip J. Frink, Title: "Simulations Comparing Different Initial Responses to Kicks Taken During Managed Pressure Drilling", Date: Mar. 2008, Publisher IADC/SPE, pp. 1-13.*

Authors: Jing Zhou, Øyvind Nistad Stamnes, Ole Morten Aamo and Glenn-Ole Kaasa, Title: Switched Control for Pressure Regulation and Kick Attenuation in a Managed Pressure Drilling System, Dates: Apr. 15, 2010 and Feb. 23, 2011, Publisher: IEEE Transactions on Control Systems Technology, pp. 14.*

Authors: Jing Zhou, Øyvind Nistad Stamnes, Ole Morten Aamo and Glenn-Ole Kaasa, Title: "Pressure Regulation with Kick Attenuation in a Managed Pressure Drilling System", Date: Dec. 2009, Publisher: IEEE, Joint 48th IEEE Conference on Decision and Control and 28th Chinese Control Conference, pp. 5586-5591.*

Author: Trygve Birkeland, Title: Automated Well Control Using MPD Approach, Date: Jun. 2009, Publisher: University of Stavanger, Pages Total: 79.*

* cited by examiner

METHOD FOR CHARACTERIZING SUBSURFACE FORMATIONS USING FLUID PRESSURE RESPONSE DURING DRILLING OPERATIONS

CROSS-REFERENCE TO RELATED APPLICATIONS

This application claims the benefit of U.S. Provisional Application No. 61/450,651, filed on Mar. 9, 2011, which is incorporated herein by reference.

BACKGROUND

The exploration for and production of hydrocarbons from subsurface rock formations requires devices to reach and extract the hydrocarbons from the rock formations. Such devices are typically wellbores drilled from the Earth's surface to the hydrocarbon-bearing rock formations in the subsurface. The wellbores are drilled using a drilling rig. In its simplest form, a drilling rig is a device used to support a drill bit mounted on the end of a pipe known as a "drill string." A drill string is typically formed from lengths of drill pipe or similar tubular segments threadedly connected end to end. The drill string is longitudinally supported by the drilling rig structure at the surface, and may be rotated by devices associated with the drilling rig such as a top drive, or kelly/kelly busing assembly. A drilling fluid made up of a base fluid, typically water or oil, and various additives is pumped down a central opening in the drill string. The fluid exits the drill string through openings called "jets" in the body of the rotating drill bit. The drilling fluid then circulates back toward the surface in an annular space formed between the wellbore wall and the drill string, carrying the cuttings from the drill bit so as to clean the wellbore. The drilling fluid is also formulated such that the fluid pressure applied by the drilling fluid is typically greater than the surrounding formation fluid pressure, thereby preventing formation fluids from entering the wellbore and the collapse of the wellbore. However, such formulation also must provide that the hydrostatic pressure does not exceed the pressure at which the formations exposed by the wellbore will fail (fracture).

It is known in the art that the actual pressure exerted by the drilling fluid ("hydrodynamic pressure") is related to its formulation as explained above, its other rheological properties, such as viscosity, and the rate at which the drilling fluid is moved through the drill string into the wellbore. It is also known in the art that, by suitable control over the discharge of drilling fluid from the wellbore through the annular space, it is possible to exert pressure in the annular space between the drill string and the wellbore wall that exceeds the hydrostatic and hydrodynamic pressures by a selected amount. There have been developed a number of drilling systems called "dynamic annular pressure control" (DAPC) systems that perform the foregoing fluid discharge control. One such system is disclosed, for example, in U.S. Pat. No. 6,904,981 issued to van Riet and assigned to the assignee of the present disclosure. The DAPC system disclosed in the '981 patent includes a fluid backpressure system in which fluid discharge from the borehole is selectively controlled to maintain a selected pressure at the bottom of the borehole, and fluid is pumped down the drilling fluid return system to maintain annulus pressure during times when the mud pumps are turned off (and no mud is pumped through the drill string). A pressure monitoring system is further provided to monitor detected borehole pressures, model expected borehole pressures for further drilling and to control the fluid backpressure system. U.S. Pat. No. 7,395,878 issued to Reitsma et al. and assigned to the assignee of the present disclosure describes a different form of DAPC system.

The formulation of the drilling fluid and when used, supplemental control over the fluid discharge such as by using a DAPC system, are intended to provide a selected fluid pressure in the wellbore during drilling. Such fluid pressure is, as explained above, selected so that fluid pressure from the pore spaces of certain subsurface formations does not enter the wellbore, so that the wellbore remains mechanically stable during continued drilling operations, and so that exposed rock formation are not hydraulically fractured during drilling operations. DAPC systems, in particular, provide increased ability to control the fluid pressure in the wellbore during drilling operations without the need to reformulate the drilling fluid extensively. As explained in the patents referenced above, using DAPC systems may also enable drilling wellbores through formations having fluid pressures and fracture pressures such that drilling using only formulated drilling fluid and uncontrolled fluid discharge from the wellbore is essentially impossible.

It is desirable to be able to characterize formation fluid pressure response as early as is practical in the wellbore construction process. Such characterization may confirm the commercial usefulness of a particular subsurface formation subjected to later testing and evaluation. The characterization may be used to assist in decisions about what forms of reservoir production testing may be applicable to a particular subsurface formation and/or the characterization may assist in determining optimum fluid pressures during wellbore drilling to avoid mechanical and/or permeability damage to the formations.

SUMMARY

A method for characterizing a subsurface formation using a fluid pressure response during wellbore drilling operations comprises the steps of determining a change in wellbore/annulus pressure proximate the surface, calculating a change in volumetric flow rate out of the wellbore as a function of the change in wellbore pressure proximate the surface, determining a downhole fluid pressure in the wellbore corresponding to the change in wellbore pressure proximate the surface and determining a productivity index value as a function of the change in volumetric flow rate, the downhole fluid pressure and a reservoir pressure.

In a process known as "fingerprinting," the annulus fluid pressure is decreased until fluid flow into the wellbore from the subsurface formation is detected at the surface. A first flow rate of fluid entering the wellbore from the subsurface formation is estimated from a determined flow rate of drilling fluid into the wellbore and at least one of a measured fluid flow rate out of the wellbore or an estimated fluid flow rate, which is based on the decreased annulus pressure and the fluid flow rate into the wellbore. The annulus fluid pressure is then further decreased by a selected amount and a second flow rate of fluid into the wellbore from the subsurface formation is estimated in a similar manner as the first flow rate. A fluid flow rate of the formation with respect to downhole pressure is determined using a value of the decreased pressure, a value of the further decreased pressure, the first flow rate and the second flow rate. The relationship between the fluid flow rate of the formation and the downhole pressure has been found to be approximately linear at low fluid flow rates from the formation. Using such linear relationship, the reservoir pressure for a given wellbore depth is then estimated when fluid flow rate from the formation is zero or near zero.

A wellbore may be characterized by a relationship between volumetric flow out of the well and wellbore pressure changes proximate the surface. Such characterization assumes that no flow into or out of the formation occurs. To determine such relationship, the surface pressure is measured for differing volumetric flow rates passing through the wellbore. At least two different volumetric flow rates and their corresponding wellbore pressures proximate the surface are necessary to characterize the wellbore; however additional data is helpful in improving the accuracy of the characterization. It has been found that a near linear relationship exists between volumetric flow out of the well and wellbore pressure changes proximate the surface. Therefore, a linear best fit of the data is preferably employed to determine such relationship. By employing this determined relationship that is specific to a particular wellbore and geometry/depth thereof, changes in wellbore pressure proximate the surface can be used to determine a corresponding change in volumetric flow of fluid out of the wellbore. Employing the characterization of the wellbore in this manner may be helpful when measured volumetric flow from the wellbore is unavailable or unreliable.

In one or more methods of the disclosure, the reservoir pressure is estimated using the previously described fingerprinting process and/or a dynamic leak off test, as disclosed herein. The wellbore is then characterized by determining the linear relationship between volumetric flow versus wellbore pressure proximate the surface for a given wellbore geometry. Next, the productivity index, PI, of the wellbore (for given a wellbore geometry), which is a characterization of the subsurface formation, is calculated as a function of reservoir pressure, downhole pressure, and volumetric flow of fluid out of the wellbore. After the productivity index is calculated, the volumetric flow of fluid out of the wellbore may be more readily calculated and/or monitored as a function of measured or monitored downhole/bottom hole pressure.

Other aspects and advantages of one or more embodiments of the invention will be apparent from the following description and the appended claims.

DETAILED DESCRIPTION

Methods according to one or more embodiments of the disclosure in general make use of a dynamic annular pressure control (DAPC) system during drilling operations involving a wellbore to adjust the fluid pressure in a wellbore annulus (i.e., the annular space between the wall of the wellbore and the exterior of the drill string) to selected values during drilling operations, and testing the response of the formations to such adjustments. Testing the wellbore response may include determining whether fluid is entering the wellbore from the formation or is being lost into the formation.

Figure 1:
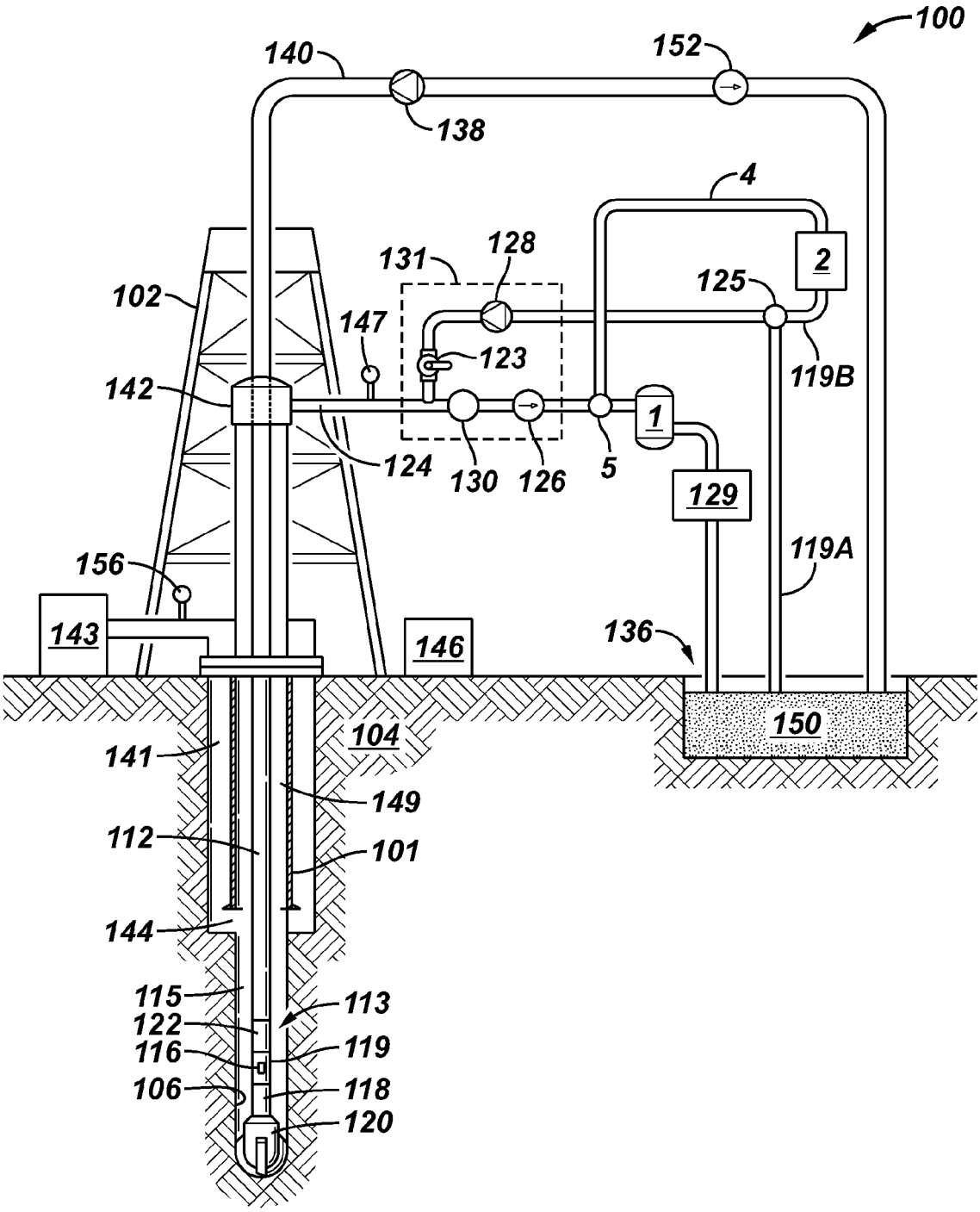
FIG. 1 shows an example of a wellbore drilling unit including a dynamic annular pressure control (DAPC) system.

An example of a drilling unit drilling a wellbore through subsurface rock formations, including a dynamic annular pressure control (DAPC) system is shown schematically in FIG. 1. Operation and details of the DAPC system may be substantially as described in U.S. Pat. No. 7,395,878 issued to Reitsma et al. and assigned to the assignee of the present disclosure or may be as described in U.S. Pat. No. 6,904,981 issued to van Riet and assigned to the assignee of the present disclosure, both incorporated herein by reference.

The drilling system 100 includes a hoisting device known as a drilling rig 102 that is used to support drilling operations through subsurface rock formations such as shown at 104. Many of the components used on the drilling rig 102, such as a kelly (or top drive), power tongs, slips, draw works and other equipment are not shown for clarity of the illustration. A wellbore 106 is shown being drilled through the rock formations 104. A drill string 112 is suspended from the drilling rig 102 and extends into the wellbore 106, thereby forming an annular space (annulus) 115 between the wellbore wall and the drill string 112, and/or between a casing 101 (when included in the wellbore) and the drill string 112. One of the functions of the drill string 112 is to convey a drilling fluid 150 (shown in a storage tank or pit 136), the use of which is for purposes as explained in the Background section herein, to the bottom of the wellbore 106 and into the wellbore annulus 115.

The drill string 112 supports a bottom hole assembly ("BHA") 113 proximate the lower end thereof that includes a drill bit 120, and may include a mud motor 118, a sensor package 119, a check valve (not shown) to prevent backflow of drilling fluid from the annulus 115 into the drill string 112. The sensor package 119 may be, for example, a measurement while drilling and logging while drilling (MWD/LWD) sensor system. In particular the BHA 113 may include a pressure transducer 116 to measure the pressure of the drilling fluid in the annulus 115 near the bottom of the wellbore 106. The BHA 113 shown in FIG. 1 can also include a telemetry transmitter 122 that can be used to transmit pressure measurements made by the transducer 116, MWD/LWD measurements as well as drilling information to be received at the surface. A data memory including a pressure data memory may be provided at a convenient place in the BHA 113 for temporary storage of measured pressure and other data (e.g., MWD/LWD data) before transmission of the data using the telemetry transmitter 122. The telemetry transmitter 122 may be, for example, a controllable valve that modulates flow of the drilling fluid through the drill string 112 to create pressure variations detectable at the surface. The pressure variations may be coded to represent signals from the MWD/LWD system and the pressure transducer 116.

The drilling fluid 150 may be stored in a reservoir 136, which is shown in the form of a mud tank or pit. The reservoir 136 is in fluid communications with the intake of one or more mud pumps 138 that in operation pump the drilling fluid 150 through a conduit 140. An optional flow meter 152 can be provided in series with one or more mud pumps 138, either upstream or downstream thereof. The conduit 140 is connected to suitable pressure sealed swivels (not shown) coupled to the uppermost segment ("joint") of the drill string 112. During operation, the drilling fluid 150 is lifted from the reservoir 136 by the pumps 138, is pumped through the drill string 112 and the BHA 113 and exits the through nozzles or courses (not shown) in the drill bit 120, where it circulates the cuttings away from the bit 120 and returns them to the surface through the annulus 115. The drilling fluid 150 returns to the surface and goes through a drilling fluid discharge conduit 124 and optionally through various surge tanks and telemetry systems (not shown) to be returned, ultimately, to the reservoir 136.

A pressure isolating seal for the annulus 115 is provided in the form of a rotating control head forming part of a blowout preventer ("BOP") 142. The drill string 112 passes through the BOP 142 and its associated rotating control head. When actuated, the rotating control head on the BOP 142 seals around the drill string 112, isolating the fluid pressure therebelow, but still enables drill string rotation and longitudinal movement. Alternatively a rotating BOP (not shown) may be used for essentially the same purpose. The pressure isolating seal forms a part of a back pressure system (a greater portion f which is represented by dotted box 131) used to maintain a selected fluid pressure in the annulus 115.

As the drilling fluid returns to the surface it goes through a side outlet below the pressure isolating seal (rotating control head) to a back pressure system 131 configured to provide an adjustable back pressure on the drilling fluid in the annulus 115. The back pressure system comprises a variable flow restrictive device, suitably in the form of a wear resistant choke 130, which applies a corresponding back pressure on the drilling fluid in the annulus 115 as flow is restricted through such device. It will be appreciated that chokes exist that are designed to operate in an environment where the drilling fluid 150 contains substantial drill cuttings and other solids. The choke 130 is one such type and is further capable of operating at variable pressures, flowrates and through multiple duty cycles.

The drilling fluid 150 exits the choke 130 and flows through an optional flow meter 126 to be directed through an optional degasser 1 and solids separation equipment 129. The degasser 1 and solids separation equipment 129 are designed to remove excess gas and other contaminants, including drill cuttings, from the drilling fluid 150. After passing through the solids separation equipment 129, the drilling fluid 150 is returned to reservoir 136.

The flow meter 126 may be a mass-balance type or other high-resolution flow meter. A pressure sensor 147 can be optionally provided in the drilling fluid discharge conduit 124 upstream of the variable flow restrictive device (e.g., the choke 130). A flow meter, similar to flow meter 126, may be placed upstream of the back pressure system 131 in addition to the back pressure sensor 147. A back pressure control means, e.g., preferably a programmed computer system but which may also be a trained operator, monitor data relevant for the annulus pressure, including data from a pressure monitoring system 146 (i.e., pressure sensor data), and provide control signals to at least the back pressure system 131 (and/or specifically to the back pressure pump 128) and optionally also to the injection fluid injection system.

In general terms, the required back pressure to obtain the desired annulus pressure proximate the bottom of the wellbore 106 can be determined by obtaining at selected times information on the existing pressure of the drilling fluid in the annulus 115 in the vicinity of the BHA 113, referred to as the bottom hole pressure (BHP), comparing the information with a desired BHP and using the differential between these for determining a set-point back pressure. The set point back pressure is used for controlling the back pressure system in order to establish a back pressure close to the set-point back pressure. Information concerning the fluid pressure in the annulus 115 proximate the BHA 113 may be determined using an hydraulic model and measurements of drilling fluid pressure as it is pumped into the drill string and the rate at which the drilling fluid is pumped into the drill string (e.g., using a flow meter or a "stroke counter" typically provided with piston type mud pumps). The BHP information thus obtained may be periodically checked and/or calibrated using measurements made by the pressure transducer 116.

The injection fluid pressure in an injection fluid supply 143 passage represents a relatively accurate indicator for the drilling fluid pressure in the drilling fluid gap at the depth where the injection fluid is injected into the drilling fluid gap. Therefore, a pressure signal generated by an injection fluid pressure sensor anywhere in the injection fluid supply passage, e.g., at 156, can be suitably used to provide an input signal for controlling the back pressure system 131 (e.g., choke 130), and for monitoring the drilling fluid pressure in the wellbore annulus 115.

The pressure signal can, if so desired, optionally be compensated for the density of the injection fluid column and/or for the dynamic pressure loss that may be generated in the injection fluid between the injection fluid pressure sensor 156 in the injection fluid supply passage and where the injection into the drilling fluid return passage takes place 144, for instance, in order to obtain an exact value of the injection pressure in the drilling fluid return passage at the depth 144 where the injection fluid is injected into the drilling fluid gap.

The pressure of the injection fluid in the injection fluid supply passage 141 is advantageously utilized for obtaining information relevant for determining the current bottom hole pressure. As long as the injection fluid is being injected into the drilling fluid return stream, the pressure of the injection fluid at the injection depth can be assumed to be equal to the drilling fluid pressure at the injection point 144. Thus, the pressure as determined by the injection fluid pressure sensor 156 can advantageously be used to generate a pressure signal for use as a feedback signal for controlling or regulating the back pressure system 131.

It should be noted that the change in hydrostatic contribution to the down hole pressure that would result from a possible variation in the injection fluid injection rate, is in close approximation compensated by the above described controlled re-adjusting of the back pressure system 131 by the back pressure control means. Thus, by controlling the back pressure system 131, the fluid pressure in the bore hole 106 is almost independent of the rate of injection fluid injection.

One possible way to use the pressure signal corresponding to the injection fluid pressure, is to control the back pressure system 131 so as to maintain the injection fluid pressure on a certain suitable constant value throughout the drilling or completion operation. The accuracy is increased when the injection point 144 is in close proximity to the bottom of the bore hole 106.

When the injection point 144 is not so close to the bottom of the wellbore 106, the magnitude of the pressure differential over the part of the drilling fluid return passage stretching between the injection point 144 and the bottom of the wellbore 106 is preferably established. For this situation, a hydraulic model can be utilized as will be described below.

In one example, the pressure difference of the drilling fluid in the drilling fluid return passage in a lower part of the wellbore 106 extending between the injection fluid injection point 144 and the bottom of the well bore 106, can be calculated using a hydraulic model taking into account inter alia the well geometry. Because the hydraulic model is generally only used for calculating the pressure differential over a relatively small section of the wellbore 106, the precision is expected to be much better than when the pressure differential over the entire wellbore length must be calculated.

In this example, the back pressure system 131 can be provided with a back pressure pump 128, in fluid communication with the wellbore annulus 115 and the choke 130, to pressurize the drilling fluid in the drilling fluid discharge conduit 124 upstream of the flow restrictive device 130. The intake of the back pressure pump 128 is connected, via conduit 119A/B, to a drilling fluid supply which may be the reservoir 136. A stop valve 125 may be provided in conduit 119A/B to isolate the back pressure pump 128 from the drilling fluid supply 136. Optionally, a valve 123 may be provided to selectively isolate the back pressure pump 128 from the drilling fluid discharge conduit 124 and choke 130.

The back pressure pump 128 can be engaged to ensure that sufficient flow passes the choke 130 to be able to maintain backpressure, even when there is insufficient flow coming from the wellbore annulus 115 to maintain pressure on the choke 130. However, in some drilling operations it may often suffice to increase the weight of the fluid contained in the upper part 149 of the well bore annulus by reducing the injection fluid injection rate when the circulation rate of drilling fluid 150 via the drill string 112 is reduced or interrupted.

The back pressure control means in the present example can generate the control signals for the back pressure system 131, suitably adjusting not only the variable choke 130 but also the back pressure pump 128 and/or valve 123.

In this example, the drilling fluid reservoir 136 also comprises a trip tank 2 in addition to the illustrated mud tank or pit. A trip tank is normally used on a drilling rig to monitor drilling fluid gains and losses during movement of the drill string into and out of the wellbore 106 (known as "tripping operations"). The trip tank 2 may not be used extensively when drilling using a multiphase fluid system involving injection of a gas into the drilling fluid return stream, because the wellbore 106 may often remain alive (i.e., continuously flowing) or the drilling fluid level in the well bore 106 drops when the injection gas pressure is bled off. However, in the present embodiment, the functionality of the trip tank 2 is maintained, for those instance for occasions where a high-density drilling fluid is pumped down into high-pressure wells.

A valve manifold system 5, 125 can be provided downstream of the back pressure system 131 to enable selection of the reservoir to which drilling mud returning from the wellbore 106 is directed. In the present example, the valve manifold system 5, 125 can include a two way valve 5, allowing drilling fluid 150 returning from the well bore 106 or to be directed to the mud pit 136 or the trip tank 2.

The valve manifold system 5, 125 may also include a two way valve 125 provided for either feeding drilling fluid 150 from reservoir 136 via conduit 119A or from trip tank/reservoir 2 via conduit 119B to backpressure pump 128, optionally provided in fluid communication with the drilling fluid return passage 115 and the choke 130.

In operation, valve 125 is operated to select either conduit 119A or conduit 119B and the backpressure pump 128 is engaged to ensure sufficient flow passes the choke 130 so that backpressure on the annulus 115 is maintained, even when there is little to no flow coming from the annulus 115. Unlike the drilling fluid passage inside the drill string 112, the injection fluid supply 143 passage can preferably be dedicated to one task, which is supplying the injection fluid for injection into the drilling fluid gap, e.g., at injection point 144. In this way, the hydrostatic and hydrodynamic interaction of the drilling fluid with the injection fluid can be accurately determined and kept constant during a drilling operation, so that the weight of the injection fluid and dynamic pressure loss in the supply passage 141 can be accurately established.

The description of the drilling system above with reference to FIG. 1 is to provide an example of drilling a wellbore using a DAPC system which can determine and maintain the annulus fluid pressure near the bottom of the wellbore 106, i.e., the above-described BHP, at or near a selected/desired value. Such system may include an hydraulics model that, as explained above, uses as input the rheological properties of the drilling mud/fluid 150, the rate at which the mud/fluid flows into the wellbore 106, the wellbore and drill string configuration, pressure on the discharge conduit 124 and if available, measurements of annulus fluid pressure proximate the bottom of the wellbore (e.g., from transducer 116) to supplement or refine calculations made by the hydraulics model.

In one or more methods according to the disclosure, the DAPC system may be operated in a specific manner to provide an estimate of formation fluid pressure response (i.e., the reservoir pressure) while drilling operations are underway. In a process known as "fingerprinting," the DAPC system may be operated to selectively reduce the bottom hole pressure (e.g., to determine the reservoir pressure). Such reduction may conducted in selected decrements, e.g., as non-limiting examples, five to twenty-five psi reductions. Measurements of (e.g., via flow meter), or estimates of (e.g., via modeling), fluid flow rate out of the wellbore and fluid flow rate into the wellbore are conducted and compared for each such pressure decrement. Flow rates out of the wellbore that exceed the rate of flow into the wellbore above a selected threshold amount, or more, may indicate fluid entry into the wellbore as a result of bottom hole pressure being below the formation fluid pressure. The reservoir pressure is determined as the downhole/bottom hole pressure such that any decrease in downhole/bottom hole pressure will cause flow from the formation (and thus a greater flow rate out of the wellbore as compared to flow rate into the wellbore). The foregoing procedure may be performed during active drilling of the wellbore (i.e., as the wellbore is lengthened by the action of the drill bit) or during other drilling operations (e.g., tripping the drill string, etc.). When using a DAPC system as described above, changes in fluid flow rate out of the wellbore may be detected substantially instantaneously by changes in wellbore annulus pressure measured proximate (at or near) the surface. For example, for any selected flow rate and pressure of fluid into the wellbore, an increase in annulus pressure measured proximate the surface may be indicative of fluid flow into the wellbore from the surrounding formations.

Figure 2:
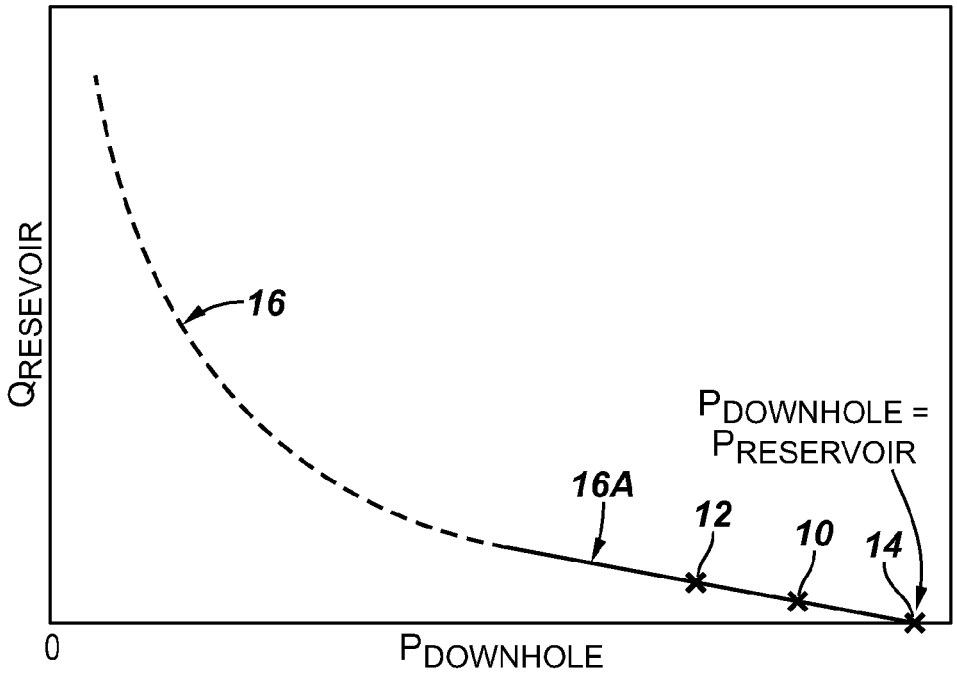
FIG. 2 shows a graph of formation fluid flow entering a wellbore from a subsurface formation as a function of wellbore fluid pressure at the subsurface level of the formation.

FIG. 2 shows a graph of volumetric fluid flow rate from a formation into a wellbore with respect to the down hole fluid pressure in the wellbore. Generally, the flow rate follows a hyperbolic curve 16 with respect to pressure change, such that volumetric flow into the wellbore from the formation increases substantially as downhole pressure decreases. At close to zero volumetric flow rate into the wellbore from the formation, the curve 16 is approximately linear 16A. Such characteristic of the pressure/flow rate relationship may be used to estimate the productivity of the formation at a given wellbore depth, as will be further disclosed hereinafter. To determine the approximately linear relationship between volumetric flow and downhole pressure as volumetric flow approaches zero, the wellbore fluid pressure in the annular space (annulus) 115 (FIG. 1) of a balanced well may be reduced in selected decrements, as disclosed above, until fluid flow into the wellbore 106 (FIG. 1) is detected. Such detection may be performed by measurement of flow rate into the wellbore (e.g., such as may be estimated by a stroke counter on the pump 138 in FIG. 1, or by direct measurement thereof via flow meter) and determination of flow rate out of the wellbore. Pressure reduction may be obtained by reducing the restriction of fluid flow provided by the back pressure system (explained with reference to FIG. 1) or by reducing the flow rate of fluid into the wellbore, e.g., by reducing the operating rate of the pump (138 in FIG. 1) at the surface. The flow rate out of the wellbore may be measured, e.g., by a flow meter (126 in FIG. 1), rate of change in mud tank volume, etc. or may be estimated by the rate of fluid flow into the wellbore and the wellbore annulus pressure as measured (and explained) with reference to FIG. 1. The wellbore/annulus fluid pressure may also be measured, such as by using a pressure measurement while drilling (PWD) sensor proximate the bottom end portion of the drill string. Thus, after a first reduction in well bore fluid pressure is initiated, a first volumetric flow rate of fluid out of the wellbore and a corresponding downhole/bottom hole well bore fluid pressure are determined via actual measurement (sensor) or estimation (modeling). The volumetric flow rate and downhole/bottom hole wellbore pressure are shown at point 10 on the graph on FIG. 2.

Then, the wellbore fluid pressure may be further decreased by a selected amount and a second volumetric flow rate of fluid from the formation into the wellbore may be determined, in a manner previously disclosed. The further decrease in the fluid pressure in the wellbore is accomplished, as explained above, either by lowering/easing the restriction (e.g., choke) in the wellbore flow outlet, or by reducing the flow rate of fluid into the wellbore. The fluid will enter the wellbore from the formation at a second, generally higher volumetric flow rate at the further decreased wellbore annulus fluid pressure than after the first act of reducing wellbore annulus fluid pressure. The further reduced wellbore pressure and corresponding increased volumetric flow rate into the wellbore are shown at point 12 on FIG. 2.

As previously stated, the relationship between volumetric flow from the formation and downhole wellbore pressure is approximately linear at close to zero volumetric flow; therefore these first and second flow rates may be used with their corresponding well bore fluid pressures to determine the equation for this linear relationship. Using this equation, a fluid flow characteristic of the subsurface formation(s), i.e., the reservoir pressure for a given wellbore depth/formation, may be estimated. The reservoir pressure (i.e., static pressure of the subsurface formation) may be estimated, at 14, by extrapolating the line equation between the first and second flow rates, and their corresponding well bore fluid pressures, to the well bore pressure that would be measured at zero flow rate. As previously stated, the reservoir pressure is the downhole pressure at which any further reduction in downhole pressure will cause flow from the formation.

In a process known as a "dynamic leak off test," the DAPC system may be operated to selectively increase the wellbore/bottom hole pressure. A change in fluid flow rate out of the wellbore is determined, as previously described with respect to the fingerprinting process. The wellbore/bottom hole pressure may be further increased and another change in fluid flow rate out of the wellbore may be determined, as previously described. A reduction in volumetric flow rate, indicative of fluid loss into the formation, with respect to wellbore/bottom hole pressure increase is then determined from the foregoing measurements, in a similar manner as disclosed with respect to the fingerprinting process. As is well known to those skilled in the art, the dynamic leak off test may be used in conjunction with, or alternatively to, the fingerprinting process, disclosed above, to verify the reservoir pressure.

In one or more methods of the disclosure, "fingerprinting" downstream of the surface pressure sensor 147 (FIG. 1) is used to determine/formulate the relationship (e.g., as an equation) between the flow rate of formation fluids into the wellbore and the well bore fluid pressure, as further disclosed hereinafter. A wellbore may be characterized by a relationship between volumetric flow out of the well and wellbore pressure changes proximate the surface. Such characterization assumes that no flow into or out of the formation occurs. To determine such relationship, the wellbore pressure proximate the surface is measured for differing volumetric flow rates passing through the wellbore. At least two different volumetric flow rates and their corresponding wellbore pressures proximate the surface are necessary to characterize the wellbore; however additional data is helpful in improving the accuracy of the characterization. By varying the (measured) flow rates of drilling fluid/mud into the well bore (i.e., volumetric flow rate through the wellbore), the respective wellbore pressures proximate the surface may be recorded. It has been found that a near linear relationship exists between volumetric flow out of the well and wellbore pressure changes proximate the surface. Therefore, a linear best fit of the data is preferably employed to determine such relationship. The linear equation (i.e., slope and line constant), and thus the relationship between the volumetric flow rate and the wellbore pressure proximate the surface, will generally be different for each well due to differences in well geometries, downstream pipe configuration, fluid rheology and formation temperature. By employing this determined relationship that is specific to a particular wellbore and geometry/depth thereof, changes in wellbore pressure proximate the surface can be used to determine a corresponding change in volumetric flow of fluid out of the wellbore. Employing the characterization of the wellbore in this manner may be helpful when measured volumetric flow from the wellbore is unavailable or unreliable.

Figure 3:
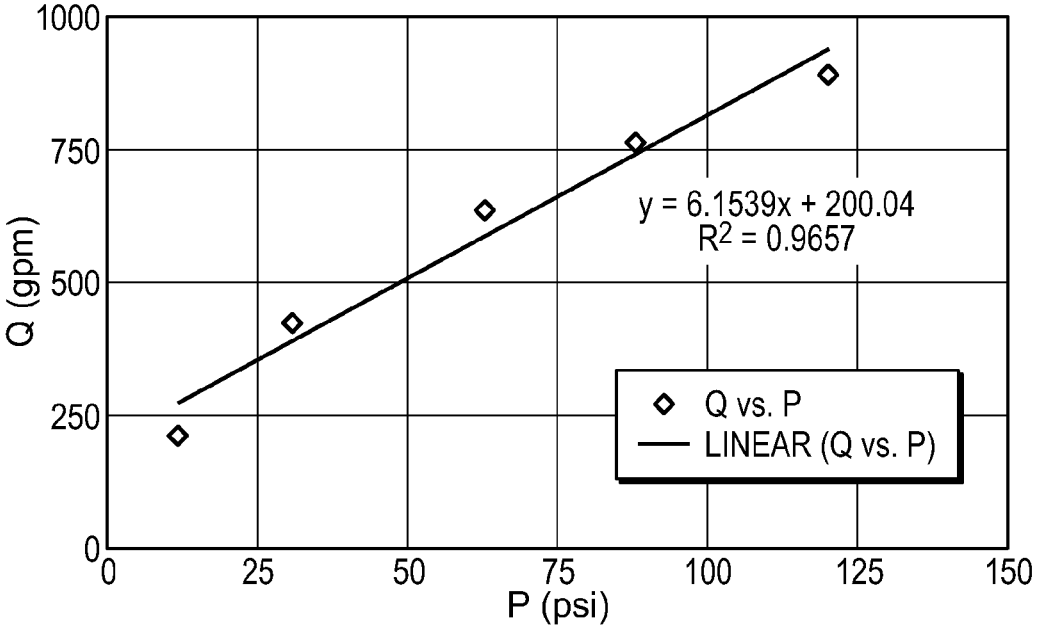
FIG. 3 shows a graph of a linear best fit of resultant flow rate versus changes in wellbore pressure used to estimate fluid flow rate into the wellbore from a formation with respect to a change in annulus fluid pressure near the surface of the Earth.

As illustrated in FIG. 3, examples of wellbore pressures proximate the surface at different volumetric flow rates for an actual well demonstrate an approximately linear relationship between fluid pressure in the wellbore and flow rate. A linear best fit of the pressure and flow rate data is used to predict the flow rate/pressure relationship which, in this example, is about 6.1539 gpm/psi.

In one or more methods of the disclosure, the reservoir pressure is estimated using the previously described fingerprinting process and/or dynamic leak off test. The wellbore is then characterized by determining the linear relationship between volumetric flow versus wellbore pressure proximate for a given wellbore geometry. The wellbore pressure proximate the surface is monitored for any change, such change being indicative of a change in volumetric flow rate out of the wellbore as a result of a change formation flow. When a change in wellbore pressure is detected, the corresponding change in volumetric flow is determined using the linear relationship previously established for the particular wellbore geometry. Also, the downhole/bottom hole pressure is measured by PWD or estimated via modeling when the change in wellbore pressure is detected.

Using this obtained data, a productivity index value, PI, of the wellbore (for a wellbore geometry), which is a characterization of the subsurface formation, is calculated using the following equation:

$$PI=Q/(P_{reservoir}-P_{downhole})$$

wherein PI represents the formation fluid flow rate index (gpm/psi), Q represents the formation fluid flow rate (gpm) $P_{reservoir}$ represents the formation fluid pressure (psi) and $P_{downhole}$ represents the wellbore pressure (psi) at the selected formation depth. As will be known to those skilled in the art, the productivity index provides a mathematical means of expressing the ability of a reservoir to deliver fluids to the wellbore and is usually given in terms of volume delivered per psi.

Thus, in one or more methods of the disclosure, the productivity index value, PI, is calculated as a function of the known quantities: reservoir pressure, downhole pressure, and volumetric flow of fluid out of the wellbore. The reservoir pressure is determined by the fingerprinting process or the dynamic leak off test, the downhole pressure is readily measured using a PWD sensor or estimated by modeling and the volumetric flow of fluid out of the wellbore is obtained via the previously characterized relationship between volumetric flow rate and wellbore pressure proximate the surface. After the productivity index value is calculated, changes in the volumetric flow of fluid out of the wellbore may be more readily calculated and/or monitored, for example, in real time and during drilling operations, as a function of the measured or monitored downhole/bottom hole pressure, by using the productivity index equation with the known quantities: reservoir pressure and PI value.

The steps of the method, as disclosed above, may be repeated as the wellbore geometry changes or wellbore conditions change as a result of drilling operations, e.g., when drilling into a new formation. Such periodic repetition of steps is necessary to properly determined the reservoir pressure at the selected depth, characterize a new relationship between volumetric flow rate out of the wellbore and wellbore pressure proximate the surface and use these quantities to calculate a new PI value.

Figure 4:
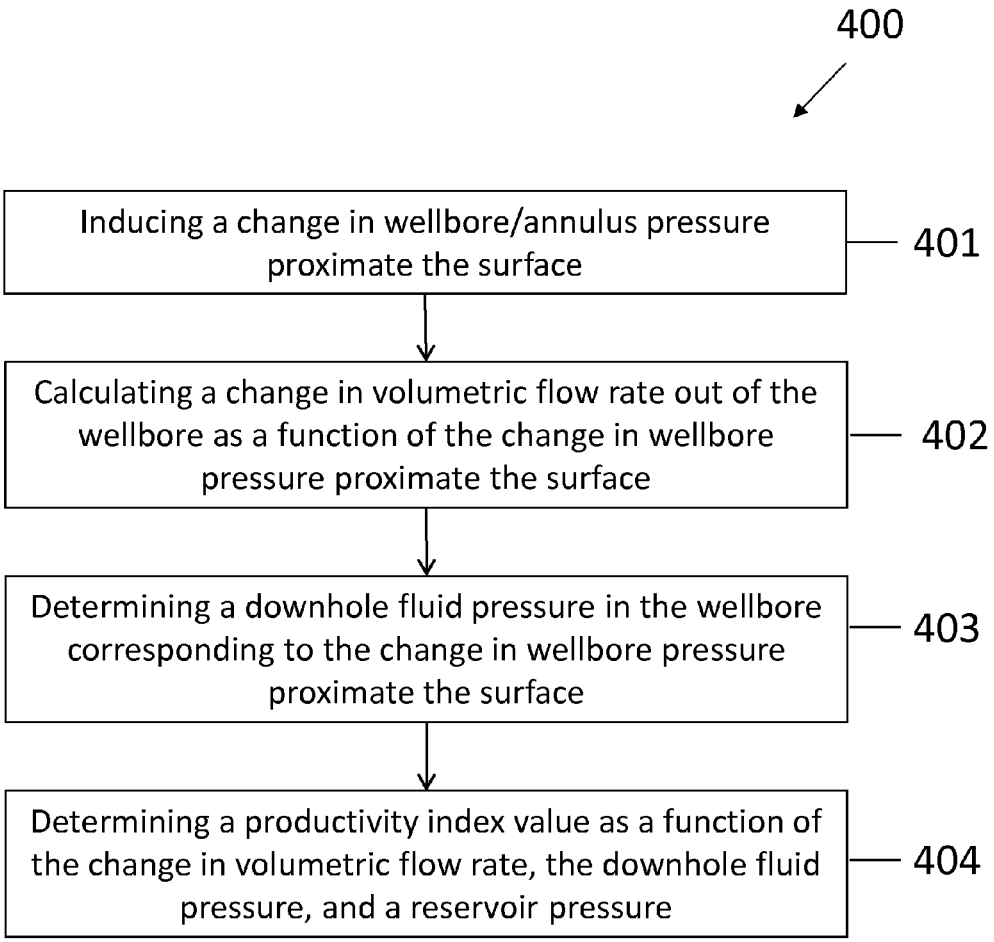
FIG. 4 shows a flow chart of a method according to one or more embodiments of the present disclosure.

Referring now to FIG. 4, a method 400 according to one or more embodiments of the present disclosure is shown. The method 400 may characterize a subsurface formation using a fluid pressure response during wellbore drilling operations. While the various steps in the following method 400 are presented sequentially, one of ordinary skill in the art will appreciate that some or all of the steps may be executed in different orders, may be combined or omitted, and some or all of the steps may be executed in parallel. The method of characterizing a subsurface formation 400 may include inducing a change in wellbore/annulus pressure proximate the surface, as shown at 401. Further, the method of characterizing a subsurface formation 400 may include calculating a change in volumetric flow rate out of the wellbore as a function of the change in wellbore pressure proximate the surface, as shown at 402. Furthermore, the method of characterizing a subsurface formation 400 may include determining a downhole fluid pressure in the wellbore corresponding to the change in wellbore pressure proximate the surface, as shown at 403. Additionally, the method of characterizing a subsurface formation 400 may include determining a productivity index value as a function of the change in volumetric flow rate, the downhole fluid pressure, and a reservoir pressure, as shown at 404.

Figure 5:
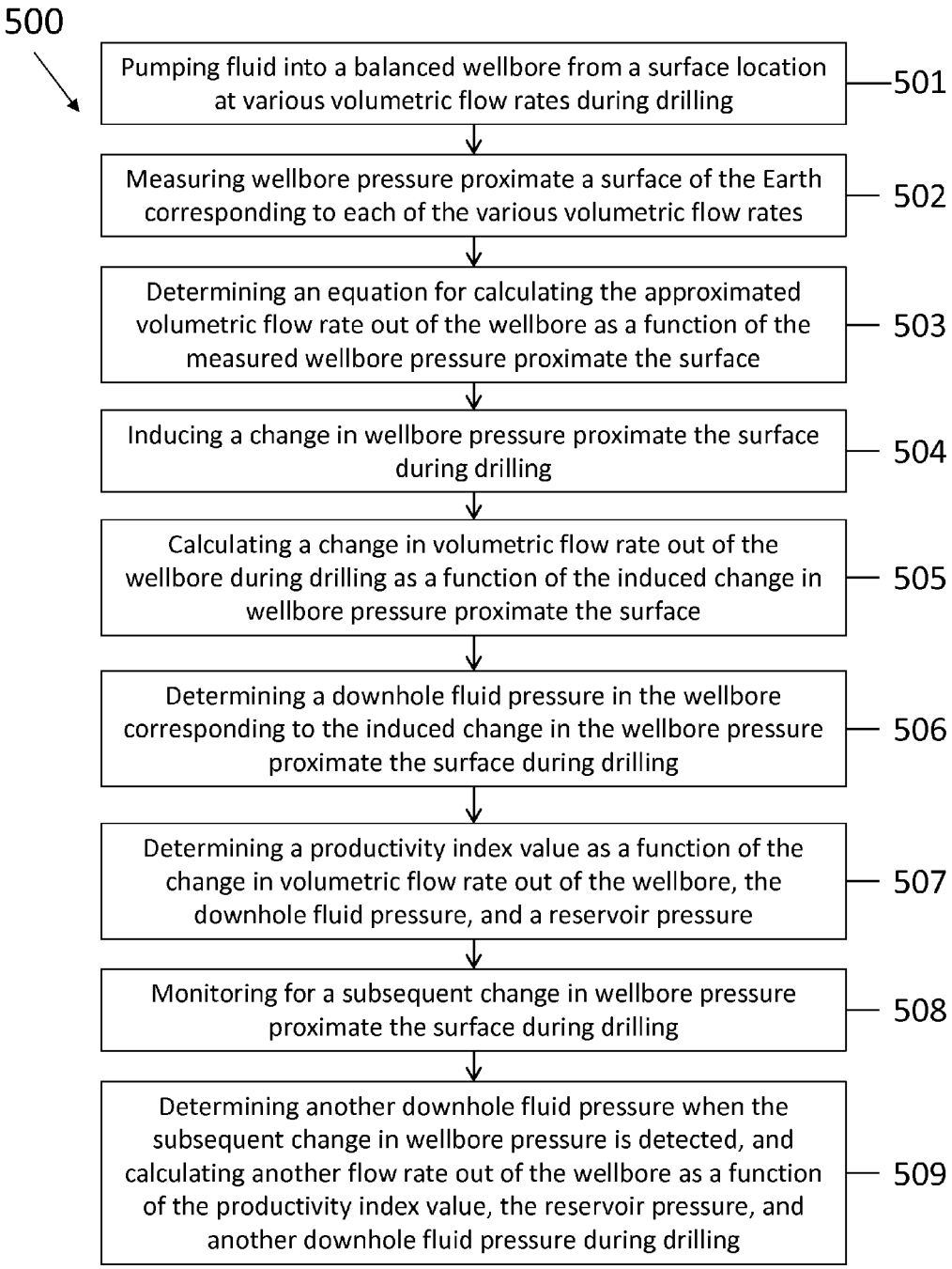
FIG. 5 shows a flow chart of a method according to one or more embodiments of the present disclosure.

Referring now to FIG. 5, a method 500 according to one or more embodiments of the present disclosure is shown. The method 500 may calculate a flow rate of fluid flowing from a wellbore based upon a fluid pressure response during wellbore drilling operations. While the various steps in the following method 500 are presented sequentially, one of ordinary skill in the art will appreciate that some or all of the steps may be executed in different orders, may be combined or omitted, and some or all of the steps may be executed in parallel. Further, a first method element 501 may include pumping fluid into a balanced wellbore from a surface location at various volumetric flow rates during drilling, in which the pumping step occurs when little or no formation fluid is flowing into the wellbore such that volumetric flow rate of fluid being pumped into the wellbore approximates the volumetric flow rate of fluid flowing out of the wellbore. Furthermore, a second method element 502 may include measuring wellbore pressure proximate a surface of the Earth corresponding to each of the various volumetric flow rates pumped during method element 501 while drilling. Moreover, a third method element 503 may include determining an equation for calculating the approximated volumetric flow rate out of the wellbore as a function of the measured wellbore pressure proximate the surface. Additionally, a fourth method element 504 may include inducing a change in wellbore pressure proximate the surface during drilling, and a fifth method element 505 may include calculating a change in volumetric flow rate out of the wellbore during drilling as a function of the induced change in wellbore pressure proximate the surface using the determined equation. Further, a sixth method element 506 may include determining a downhole fluid pressure in the wellbore corresponding to the induced change in the wellbore pressure proximate the surface during drilling. Furthermore, a seventh method element 507 may include determining a productivity index value as a function of the change in volumetric flow rate out of the wellbore, the downhole fluid pressure, and a reservoir pressure. Additionally, an eighth method element 508 may include monitoring for a subsequent change in wellbore pressure proximate the surface during drilling. Further, a ninth method element 509 may include determining another downhole fluid pressure when the subsequent change in wellbore pressure is detected during drilling, and calculating another flow rate out of the wellbore as a function of the productivity index value, the reservoir pressure, and the another downhole fluid pressure during drilling.

One or more methods, according to the various aspects of this disclosure, provide an estimate of subsurface formation fluid productivity while wellbore drilling operations are in progress. Such estimates may enhance the accuracy or predictive value of subsequent formation production testing however such testing is performed. While volumetric flow rate is disclosed herein, those skilled in the art will readily recognize that alternative measurements of flow rate into and/or out of the wellbore may be equally employed for the methods disclosed herein.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method comprising:

characterizing a subsurface formation using a fluid pressure response during wellbore drilling operations, wherein characterizing the subsurface formation comprises:

determining a change in volumetric flow rate out of the wellbore and determining a downhole fluid pressure in the wellbore while inducing a change in wellbore pressure proximate a surface of the Earth by lowering an annulus pressure during drilling;

determining a productivity index value as a function of the determined change in volumetric flow rate, the determined downhole fluid pressure, and a reservoir pressure; and calculating, after determining the productivity index value, a subsequent change in volumetric flow rate out of the wellbore as a function of the productivity index value, the reservoir pressure, and another downhole fluid pressure determined during drilling.

2. The method of claim 1 further comprising the step of: formulating volumetric flow rate out of the wellbore as a function of the wellbore pressure proximate the surface.

3. The method of claim 1 wherein at least one of the downhole fluid pressure or the another downhole fluid pressure is determined by using a PWD sensor proximate a bottom end portion of a drill string.

4. The method of claim 1 wherein at least one of the downhole fluid pressure or the another downhole fluid pressure is determined by modeling.

5. The method of claim 1 wherein the reservoir pressure is estimated through a fingerprinting process.

6. The method of claim 1 wherein the reservoir pressure is estimated through a dynamic leak off test.

7. The method of claim 1 further comprising the steps of: calculating another change in volumetric flow rate from the wellbore as a function of at least the productivity index value.

8. The method of claim 1 wherein the step of determining a change in volumetric flow rate out of the wellbore as a function of the change in wellbore pressure proximate the surface includes the steps of:

pumping fluid into the wellbore from a surface location at various volumetric flow rates, the pumping step occurring when no formation fluid is flowing into the wellbore such that the volumetric flow rate of fluid being pumped into the wellbore approximates the volumetric flow rate of fluid flowing out of the wellbore;

measuring wellbore pressure proximate the surface corresponding to each of the various flow rates; and formulating the volumetric flow rate out of the wellbore as a function of the wellbore pressure proximate the surface.

9. The method of claim 1 further comprising the step of: repeating all of the steps upon drilling into a new formation.

10. A method for calculating flow rate of fluid flowing from a wellbore based upon a fluid pressure response during wellbore drilling operations, the method comprising:

pumping fluid into a balanced wellbore from a surface location at various volumetric flow rates during drilling, the pumping step occurring when little or no formation fluid is flowing into the wellbore such that volumetric flow rate of fluid being pumped into the wellbore approximates the volumetric flow rate of fluid flowing out of the wellbore;

measuring wellbore pressure proximate a surface of the Earth corresponding to each of the various volumetric flow rates during drilling;

determining an equation for calculating the approximated volumetric flow rate out of the wellbore as a function of the measured wellbore pressure proximate the surface;

inducing a change in wellbore pressure proximate the surface during drilling;

calculating a change in volumetric flow rate out of the wellbore during drilling as a function of the induced change in wellbore pressure proximate the surface using the determined equation;

determining a downhole fluid pressure in the wellbore corresponding to the induced change in wellbore pressure proximate the surface during drilling;

determining a productivity index value as a function of the change in volumetric flow rate out of the wellbore, the downhole fluid pressure corresponding to the induced change in wellbore pressure proximate the surface, and a reservoir pressure;

monitoring, after determining the productivity index value, for a subsequent change in wellbore pressure proximate the surface during drilling;

determining another downhole fluid pressure when the subsequent change in wellbore pressure is detected during drilling; and calculating another flow rate out of the wellbore as a function of the productivity index value, the reservoir pressure, and the another downhole fluid pressure during drilling.

11. The method of claim 10 wherein at least one of the downhole fluid pressure or the another downhole fluid pressure is determined by using a PWD sensor proximate a bottom end portion of a drill string.

12. The method of claim 10 wherein at least one of the downhole fluid pressure or the another downhole fluid pressure is determined by modeling.

13. The method of claim 10 wherein the reservoir pressure is estimated through a fingerprinting process.

14. The method of claim 10 wherein the reservoir pressure is estimated through a dynamic leak off test.

15. The method of claim 10 wherein the steps of monitoring for the subsequent change in wellbore pressure proximate the surface, determining another downhole fluid pressure when the subsequent change in wellbore pressure is detected and calculating volumetric flow rate out of the wellbore as a function of the productivity index value, the reservoir pressure, and the another downhole fluid pressure are conducted in real time.

* * * * *